US006879695B2

(12) United States Patent
Maltan et al.

(10) Patent No.: US 6,879,695 B2
(45) **Date of Patent: *Apr. 12, 2005**

(54) PERSONAL SOUND LINK MODULE

(75) Inventors: Albert A. Maltan, Stevenson Ranch, CA (US); Janusz A. Kuzma, Parker, CO (US)

(73) Assignee: Advanced Bionics Corporation, Valencia, CA (US)

( * ) Notice: Subject to any disclaimer, the term of this patent is extended or adjusted under 35 U.S.C. 154(b) by 108 days.

This patent is subject to a terminal disclaimer.

(21) Appl. No.: 10/264,937

(22) Filed: Oct. 3, 2002

(65) Prior Publication Data

US 2003/0063764 A1 Apr. 3, 2003

Related U.S. Application Data

(60) Provisional application No. 60/327,099, filed on Oct. 3, 2001, and provisional application No. 60/327,071, filed on Oct. 3, 2001.

(51) Int. Cl.[7] ..... H04R 25/00

(52) U.S. Cl. ..... 381/315; 381/322; 600/25

(58) Field of Search ..... 600/25; 607/55, 607/56, 57; 381/315, 312, 322, 328, 329, 330, 380, 382; 379/55.1

(56) References Cited

U.S. PATENT DOCUMENTS

| | | | |
|---|---|---|---|
| 3,068,954 | A | 12/1962 | Strzalkowski |
| 3,557,775 | A | 1/1971 | Mahoney |
| 3,844,271 | A | 10/1974 | Lake |
| 4,957,478 | A | 9/1990 | Maniglia |
| 5,015,224 | A | 5/1991 | Mniglia |
| 5,411,467 | A | 5/1995 | Hortmann et al. |
| 5,430,801 | A | 7/1995 | Hill |
| 5,814,095 | A | 9/1998 | Muller et al. |

(Continued)

FOREIGN PATENT DOCUMENTS

| | | | |
|---|---|---|---|
| DE | 19854360 | A1 | 8/1999 |
| DE | 19943907 | A1 | 3/2001 |
| DE | 20018528 | U1 | 4/2001 |
| DE | 20108827 | U1 | 10/2001 |

OTHER PUBLICATIONS

Retro–X Technology, Auric Hearing Systems, "Das Horsystem Mit Retroauricularer Schallfuhrung", printed Sep. 27, 2001, 1 page.

Tzivskos and Law inventors for AB–091U; U.S. Appl. Ser. No. 09/785,629 ; filed Feb. 16, 2001; entitled "Connector System for BTE Hearing Devices".

Harrison inventor for AB–149U; U.S. Appl. Ser. No. 09/854, 420 ; filed May 11, 2001; entitled "Implantable Microphone System for Use with Cochlear Implants and Implantable Hearing Aids".

*Primary Examiner*—Curtis Kuniz
*Assistant Examiner*—Brian Ensey
(74) *Attorney, Agent, or Firm*—Laura Haburay Bishop; Bryant R. Gold

(57) ABSTRACT

A personal sound link module (60) is inserted into a tunnel (40) made through the soft tissue connecting the retroauricular space (50) with the ear canal (30). The module contains an acoustic transducer (65), located at the distal part (68) of the module, close to or inside the ear canal, an antenna (64) that receives and also potentially sends signals to a remote source, signal processing circuitry (67), telemetry circuitry (69), a power source (66) that powers the module, and possibly a microphone (63). Signals transmitted from a remote source are received through the antenna and telemetry circuitry, processed, and presented to the acoustic transducer, where they are converted to sound waves broadcast into the user's ear canal. The remote source may be a radio station, radio receiver, CD player, DVD player, tape player, audio system, telephone, TV receiver or station, or other source of audio signals intended to be heard privately by the user.

20 Claims, 4 Drawing Sheets

U.S. PATENT DOCUMENTS 5,833,626 A 11/1998 Leysieffer
5,999,632 A 12/1999 Leysieffer et al.
6,022,311 A 2/2000 Juneau et al.
6,094,493 A * 7/2000 Borowsky et al. ..... 381/328
6,099,462 A 8/2000 aWengen
6,164,284 A 12/2000 Schulman et al.
6,185,452 B1 2/2001 Schulman et al.
6,208,894 B1 3/2001 Schulman et al.
6,228,020 B1 5/2001 Juneau et al.
6,254,526 B1 7/2001 Juneau et al.
6,473,513 B1 * 10/2002 Shennib et al. ..... 381/328
6,694,034 B2 * 2/2004 Julstrom et al. ..... 381/315
6,718,043 B1 * 4/2004 Boesen ..... 381/314
2001/0053871 A1 12/2001 Zilberman, et al.
2001/0053872 A1 12/2001 Zilberman, et al.
2001/0056291 A1 12/2001 Zilberman, et al.
2003/0031336 A1 2/2003 Harrison, et al.
2003/0086583 A1 * 5/2003 Maltan et al. ..... 381/328

* cited by examiner

PERSONAL SOUND LINK MODULE

The present application claims the benefit of U.S. Provisional Patent Applications Ser. Nos. 60/327,099 and 60/327,071, both filed Oct. 3, 2001, which applications are incorporated herein by reference in their entirety.

FIELD OF THE INVENTION

The present invention relates to hearing systems, and more particularly to a hearing system that provides a personal sound link module that can be worn unobtrusively by a user to allow the user to personally listen (without others being able to hear) to audio signals received from a remote device or source, such as a telephone, wireless communications network, or personal audio system.

BACKGROUND OF THE INVENTION

Receiving sound that is not audible to others currently requires the use of speakers in headphones or ear buds. Most commonly, headphone and ear buds are connected to a sound source, such as a telephone, radio, CD player, DVD player, PC, or palm pilot, via a cable. Some are connected to the sound source via wireless link.

Telephone use requires a speaker and a microphone. Typically, the speaker and microphone are combined together in a handset that can be conveniently held in one hand of the user. New phones, including wireless phones and cell phones, include all of the phone circuits within a handset. The next generation of cell phone protocol, known as USTM, incorporates various aspects of the internet. When a connection is established between a phone handset using the USTM protocol, and a base station (which base station could be cellular transmitting station), a user of the phone can write, send, and receive email, as well as engage in other internet-related activities, in addition to conducting conventional phone calls.

Some styles of phones, including older phones, include only a microphone and speaker and limited or no circuitry in the handset, which handset is then connected to a phone base, which base includes the main telephone circuitry.

Commonly, the speaker of the telephone is held to the user's ear, while the microphone is located in a part of the telephone handset that is close to the user's mouth. Portable phones are often used with extensions that contain an "ear bud" and a microphone or headphone(s) and a microphone, thereby allowing use of the telephone without the necessity of holding the entire phone up to the head. However, such a portable phone requires a cable that runs from the telephone to the user's head.

The disadvantages of using headphones or ear buds include the following: (1) they tend to be relatively bulky and inconvenient; (2) in their most common form, they require a cable to run from the head to the sound source, thereby interfering with the listener's mobility; (3) they are worn only when needed and removed and stored while not in use; (4) while in use, they partially occlude the ear, reducing the ability to perceive other environmental sound or voice signals.

It is known in the art to connect the retro-auricular space (i.e., the space behind the pinna of the ear) to the ear canal via a hollow titanium tube that is permanently placed into soft tissue. See, e.g., U.S. Pat. No. 6,094,493, which patent is incorporated herein by reference. In one embodiment presented in the '493 patent, an amplification hearing aid is connected to the proximal (retro-auricular) end of the tube, whereby the hearing aid is located behind the pinna of the ear and a transducer sends the amplified sound signal through the tube into the ear canal. This concept, which has been commercialized by Auric® Hearing Systems, Inc. of Charlotte, N.C. as the RetroX technology, allows a certain degree of amplification without feedback and without the need for occlusion of the ear canal. In another embodiment of the '493 patent, the microphone, transducer, electrical and electronic components are installed in the tube. The '493 patent does not disclose a personal sound link.

In U.S. Pat. No. 5,430,801, the use of a silicone tube is disclosed to direct the output of a conventional hearing aid, held in place behind the ear using an ear-hook or via a piercing through the cartilage of the pinna, into the ear canal. One embodiment disclosed in the '801 patent contemplates placing the distal end of the tube in the middle ear to achieve better gain. However, such embodiment, like all middle-ear devices, involves a significant surgical procedure, and the risk of infection is much greater than a simple piercing of the soft tissue behind the ear. Further, the microphone associated with the hearing aid disclosed in the '801 patent is held at the front of the pinna, either as part of the piercing or connected to the hearing aid through an earringtype coupler. Furthermore, the '801 patent does not provide for a personal sound link.

What is therefore needed is an unobtrusive means for personal communications and/or private audio reception. Such a personal sound link should provide a safe and comfortable means of communication and/or audio reception. The personal sound link is preferably self-powered, and preferably provides wireless linking, and an optional cable connector.

SUMMARY OF THE INVENTION

The present invention addresses the above and other needs by providing a personal sound link module shaped for insertion into a tunnel made through the soft tissue connecting the retro-auricular space with the ear canal. The personal sound link module fits in the soft tissue tunnel because it takes advantage of the availability of smaller batteries or other power sources, advances in microelectronic components, and advanced mechanical design capability. The module is thus smaller and less visible than known devices, and positioned so that part or all of the device is recessed or implanted in the body so as to be largely invisible. Moreover, it does not occlude the ear canal. In addition, the personal sound link module may be capable of wireless communication, or may use a cable connection.

The personal sound link module, which may also be referred to herein as a hidden ear piece, contains a speaker, or acoustic transducer, located on the distal part of the module, close to or inside the ear canal. The module further includes, when necessary and/or desired, a power source to power the module, such as a primary battery or a rechargeable or replenishable power source, e.g., a rechargeable battery or supercapacitor. The personal sound link module can be readily removed, facilitating such battery recharging or replacement. Alternatively, if a rechargeable battery is used, it may be recharged inductively.

The personal sound link module may further include signal processing circuitry, and a telemetry circuit for receiving broadcast (wireless) signals from a desired remote source, such as a radio (e.g., AM/FM, CB, satellite, police band, short wave, etc.), TV, CD player, DVD player, PC, cellular or other telephone, palm pilot, remote microphone, or the like. Additionally, a connector is provided so that, if desired, a wired connection from a remote source may be established. In some embodiments, for instance when used with or as part of a telephone, the personal sound link module includes a two-way RF link that receives and sends signals to a phone base or directly to a communications network.

In some embodiments, a microphone is also included as part of the module, e.g., located at the proximal part of the module, close to or in the retro-auricular space behind the pinna. The microphone is designed and placed within the available space in such manner and at such orientation as to be optimally suited for picking up the voice of the user. Alternatively, a microphone may be positioned remotely and linked via cable or wireless link to the module, or directly to a remote device, such as a phone base or communications network. Optionally, the module contains circuitry that performs electronic or signal processing functions, such as voice command recognition. Such built-in or remote microphone may be selectively turned ON, when desired, thereby allowing the personal sound link module to function as a hearing aid system, or to provide two-way communications, such as via telephone.

The personal sound link module of the present invention provides at least one or more of the following: (1) visibility of the personal sound link is reduced or eliminated; (2) user comfort and safety is increased because occlusion of the ear canal is not needed and because the volume or size (bulk) and positioning of the personal sound link is optimized; (3) a cable is not required (in some embodiments) for connecting the hidden ear piece to the remote sound source; (4) hands-off telephone use is facilitated; and (5) ringing of such a telephone is heard only by the user and is essentially inaudible to others.

In one embodiment, a chronically implanted tube is placed in the retro-auricular-space-to-ear-canal tunnel, and the personal sound link module of the present invention snugly fits inside the tube. In some embodiments, the tube is coated with a film or layer of steroid(s) or other drug(s) that, over time, minimize the risk of infection and/or inflammation.

In another embodiment, an acutely implanted tube, which may be coated with a steroid(s) or drug(s), is placed in the retro-auricular-space-to-ear-canal tunnel, and the personal sound link module of the present invention snugly fits inside the tube. After a suitable time, the tube may be removed and the personal sound link module, which may be coated with a steroid(s) or drug(s), placed directly into the tunnel.

In yet another embodiment of the invention, the personal sound link module, housed in a flexible or rigid tube-like casing, is snugly inserted into the retro-auricular-space-to-ear-canal tunnel, with the speaker (acoustic transducer) located near the ear canal.

The personal sound link module is preferably encapsulated or carried in an elongate flexible or rigid case or plug that is adapted to snugly slide into the implanted tube or retro-auricular-space-to-ear-canal tunnel. Such construction facilitates insertion and removal of the module into and from the tube or tunnel for the purpose of replacing or recharging the power source, or replacing the module with a new module.

In accordance with one aspect of the invention, users of the personal sound link module would preferably have at least two such modules—one which is inserted into the retro-auricular-space-to-ear-canal tunnel or tube, and which provides the personal sound link function of the invention; and at least one other module that serves as a spare. The power source of spare module(s) may advantageously be replaced, replenished, or recharged when not in use.

BRIEF DESCRIPTION OF THE DRAWINGS

The above and other aspects of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing the general principles of the invention. The scope of the invention should be determined with reference to the claims.

Figure 1:
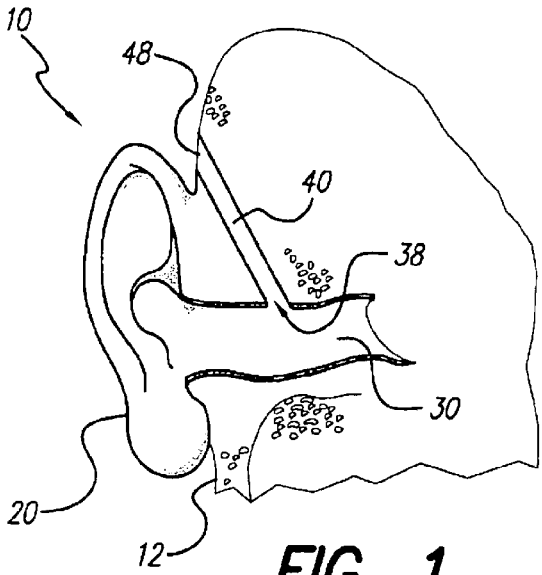
FIG. 1 schematically shows the location of a tunnel made through soft tissue to connect the retro-auricular space with the ear canal, and wherein, in one embodiment, a chronically implanted tube may be placed in such tunnel.
Figure 2:
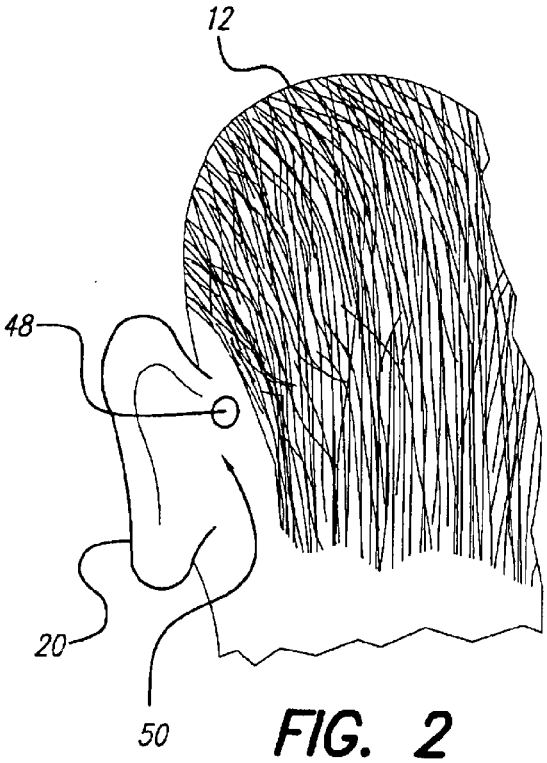
FIG. 2 depicts the end of the tunnel as it opens to the retro-auricular space behind the pinna.

Turning first to FIGS. 1 and 2, there is shown a schematic representation of an ear 10 attached to the head 12 of a user of the present invention. FIG. 1 is a front view of the ear 10 as seen when looking at the front of the head (i.e., face) of the user, whereas FIG. 2 is a view of ear 10 as seen when looking at the back of the user's head. The ear 10 has a pinna 20 (a.k.a. auricle) and an ear canal 30. The space behind the pinna 20 is known as the retro-auricular space 50. Advantageously, the retro-auricular space 50 is generally a hidden space, not readily seen or observed when others look at the user.

In accordance with the present invention, a small tunnel 40 is made through soft tissue to connect the retro-auricular space 50 with the ear canal 30. Such tunnel 40 may be referred to as the "ear-canal-to-retro-auricular-space tunnel". Such tunnel-making is readily accomplished because the tissue is very soft in this region, and the process is medically a relatively simple procedure, being essentially a body-piercing operation. Tunnel 40 need not be very long, e.g., on the order of about 7–25 mm in length, and about 2–6 mm in diameter, depending upon the dimensions of the ear of the user in whom the tunnel is made.

For purposes of the present invention, the point at which the tunnel 40 opens into the retro-auricular space 50 is referred to as opening 48, and may also be referred to as the "external opening" or the "proximal end" of tunnel 40. Similarly, the point at which tunnel 40 opens into the ear canal 30 is referred to as opening 38, and may also be referred to as the "internal opening", "ear-canal opening" or "distal end" of the tunnel 40.

Figure 3A:
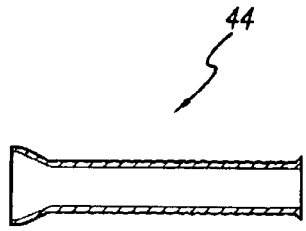
FIG. 3A shows the outline of a tube that may, in some embodiments of the invention, be inserted into the ear-canal-to-retro-auricular-space tunnel.

As is known from the prior art discussed previously, a hollow tube 44, seen in FIG. 3A, may be implanted in tunnel 40. In accordance with various embodiments of the present invention, such tube implantation may be chronic (intended for a long duration, e.g., permanent) or acute (intended for a short duration, e.g., temporary). The tube 44, when used, keeps the tunnel open and prevents tissue from collapsing or growing back into the tunnel 40. Such tube must be made from a body compatible material such as Teflon, silicone, ceramic, stainless steel, titanium, or a polymer material. Further, such tube may assume a variety of shapes, e.g., cylindrical, oval, rectangular, or other shape. The tube may further consist of several parts that connect together to allow easy surgical placement, whereby the overall length of the tube may be variable.

Figure 3B:
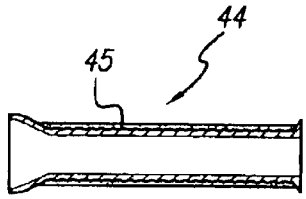
FIG. 3B shows the tube of FIG. 3A coated with a steroid or drug.

In accordance with one advantageous embodiment of the invention, and as shown in FIG. 3B, the tube 44 may be coated with a layer 45 of a steroid(s) or other drug(s) adapted to minimize the risk of infection and/or inflammation. As used herein, steroids or drugs include, but are not limited to anti-inflammatories, antibiotics, and other such beneficial drugs and substances. Such steroids or drugs may be encapsulated in a film or coating 45 designed to slowly release the steroids or drugs over a relatively long period of time, e.g., several days or weeks, thereby preventing or minimizing infection and/or inflammation during the time the tissue around the tunnel 40 heals. Representative substances or compounds that may be used to coat the tube in accordance with this aspect of the invention include steroids, such as a corticosteroid (e.g., corticosterone, cortisone, and aldosterone) or other drugs, either naturally occurring or synthetic, that prevent, minimize, and/or treat infection and/or inflammation.

A personal sound link module 60, discussed more fully below in conjunction with the description of FIGS. 4, 5, 6A, and 6B, may be inserted into the tube 44 so that a proximal end of the module 60 resides at the opening 48, and a distal end of the module 60 resides at the opening 38. The module 60 is housed in a tubular case that is sized to fit snugly within the tube 44. Advantageously, the module 60 may be readily inserted into, or removed from, the tube 44, thereby allowing the user to replace or remove the module when needed, e.g., to replace or recharge its battery or other power source.

In other embodiments of the invention, a separate tube 44 need not first be inserted into the ear-canal-to-retro-auricular-space tunnel 40. Rather, the personal sound link module 60, housed in a tubular case and sized so as to fit snugly within the tunnel 40, may simply be inserted into the tunnel 40, with a proximal end of the module 60 being located at the opening 48 of the tunnel, and with a distal end of the module 60 being positioned at the opening 38 of the tunnel.

Alternatively, tube 44 may be inserted into tunnel 40 temporarily or acutely, e.g., until the tissue has healed and likelihood of infection has passed, at which time, tube 44 may be removed and module 60 inserted. Advantageously, module 60 may be inserted into tube 44 during the time the tissue is healing.

Figure 4:
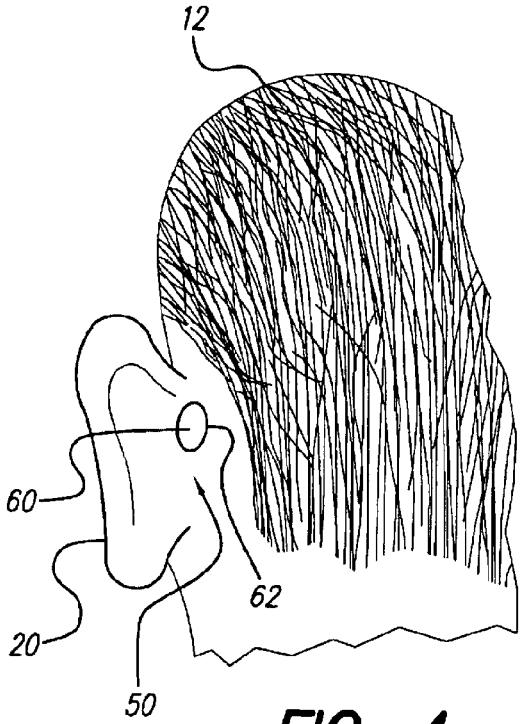
FIG. 4 depicts the space behind the pinna, as in FIG. 2, but with the personal sound link module of the present invention inserted into the tunnel or tube.

Turning next to FIG. 4, there is shown a back view of the ear 10, as is also shown in FIG. 2, but in FIG. 4 there is a personal sound link module 60 made in accordance with the present invention inserted into the tunnel 40 (or tube 44, when used), so that a proximal end 62 of the module 60 resides in retro-auricular space 50, and a distal end of the module 60 (not seen in FIG. 4) is positioned adjacent the distal end 38 of tunnel 40.

Figure 5:
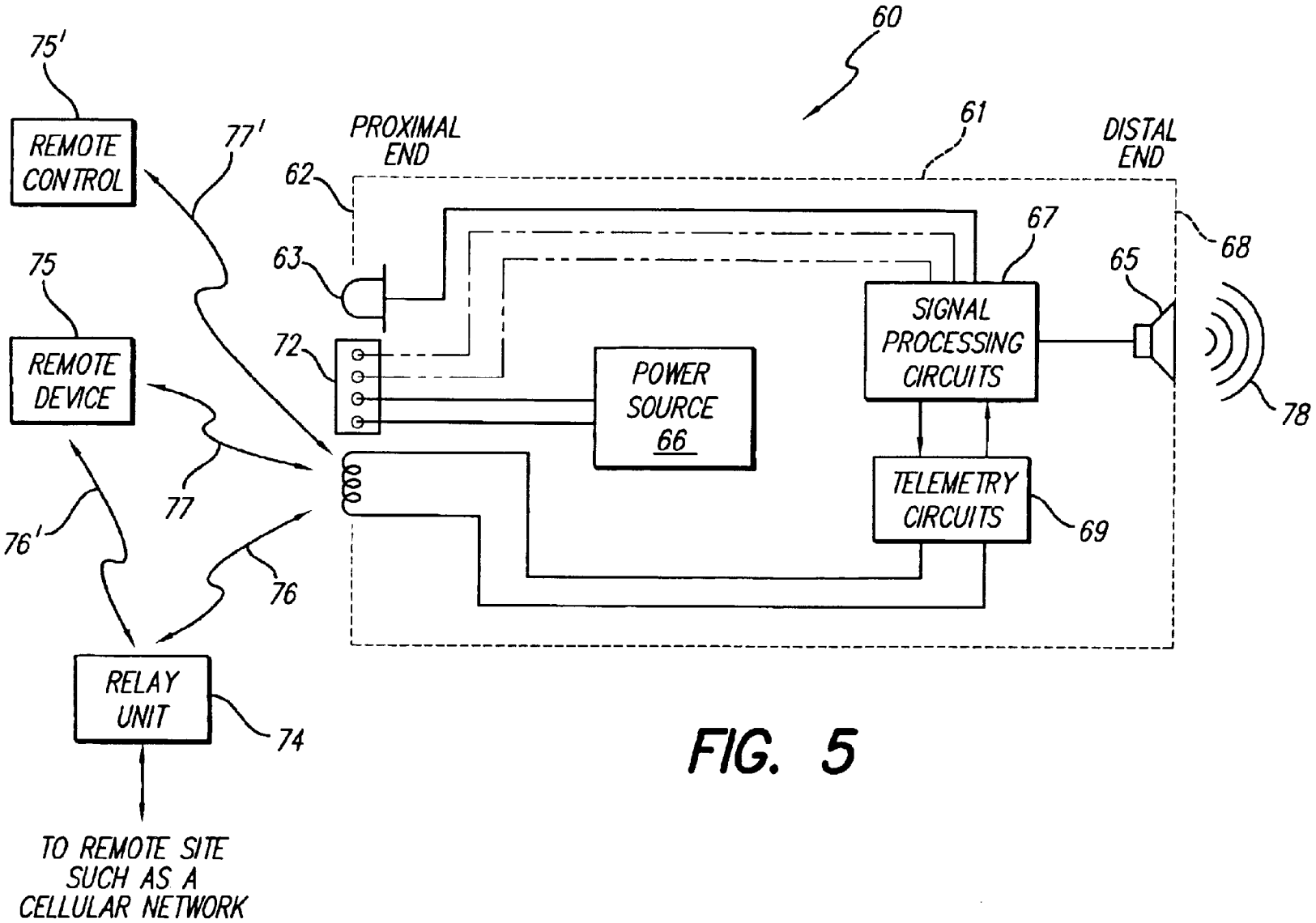
FIG. 5 is a functional block diagram of the personal sound link module of the present invention.

FIG. 5 is a functional block diagram of personal sound link module 60 of the present invention. Module 60 is preferably encapsulated or housed within a tubular (or other suitably-shaped) case 61. An antenna coil 64 may be located at a proximal end 62 of module 60, or elsewhere within module 60, such as built into case 61. A built-in microphone 63, which may preferably be turned on or off, may also be located at proximal end 62 of the module. An acoustic transducer 65, e.g., a speaker, is located at a distal end 68 of module 60.

Between the proximal end 62 and distal end 68 of the exemplary personal sound link module 60 shown in FIG. 5 is a power source 66, signal processing circuits 67, and telemetry circuits 69. A suitable connector 72 is also formed within case 61, allowing connection with power source 66, enabling the power source to be replenished and/or recharged when module 60 is removed from the tunnel 40 (or tube 44), or possibly even when module 60 remains in tunnel 40 or tube 44. Connector 72 also provides for a wired connection with a remote device, when desired.

As seen in FIG. 5, microphone 63 (when used) is connected to signal processing circuitry 67. Speaker 65 is also connected to signal processing circuitry 67. Such signal processing circuitry includes amplification, filtering, and other signal processing circuits so that sounds sensed through the microphone 63, when turned on, (which sensed sounds are transduced by the microphone into electrical signals) may be suitably amplified and filtered and presented to the speaker 65 and/or telemetry circuitry 69. For some embodiments of the present invention, the sounds sensed by the microphone 63 will be the voice of the user, but may also be ambient or other sounds. Optionally, the signal processing circuits may also contain circuitry that performs other electronic or signal processing functions, such as voice command recognition and/or processing of signals received by module 60 from a remote device and to be presented to speaker 65. For instance, when a telephone call is received, signals representative of the caller are transmitted to the telemetry circuits 69 through link 76. Such signals are then processed by the signal processing circuitry 67 and presented to speaker 65.

Telemetry circuitry 69 may be coupled through antenna 64 with a remote device 75 providing audio sound by way of a suitable telecommunications link 77, e.g., a radio frequency (RF) link. For example, remote device 75 may be a telephone (possibly utilizing a relay unit 74, such as a telephone base station and link(s) 76 and/or 76'), which may in turn be connected to a telephone land-line or wireless cellular network, or other wireless communications network, in conventional manner.

As stated earlier, remote device 75 may comprise, e.g., a radio, CD/DVD player, telephone (cellular, satellite or land-line, including a telephone coupled to the internet using, e.g., the new cell phone protocol known as USTM, or equivalent), personal computer (PC), palm pilot, TV (audio portion), or any other source that broadcasts an audio signal. The remote device 75 preferably includes a suitable wireless transmitter for sending a signal to antenna 64 over the link 77. Typically, the broadcast signal will be an RF signal, having a high frequency RF carrier signal that is modulated by the audio information. Alternatively or additionally, a conventional cable connection is provided.

In some applications, a relay unit 74 may be used with the personal sound link module 60 in order to facilitate a wireless connection with the desired remote device 75. That is, when used, such relay unit 74 includes the needed transmitter, e.g., an RF transmitter, for coupling with the personal sound link module 60 over a suitable link 76, e.g., an RF link, and if necessary, for coupling with the remote device 75 over a suitable link 76'. In some instances, relay unit 74 comprises a part of remote device 75, a part of processing circuits 67, and/or a part of telemetry circuits 69.

In some embodiments of the invention, relay unit 74 (such as a telephone base station) includes a receiver for receiving signals broadcast by the personal sound link module 60, e.g., sound signals, such as the user's voice, sensed through the built-in microphone 63. In such embodiments, the link 76 becomes a two-way link, and two-way communication is made possible with the user of module 60, and relay unit 74 transmits signals to a remote site, such as a cellular network or land-line. For example, when coupling to a telephone (whether land-line, cellular, or satellite), it is important for the user to be able to hear the person on the other end of the telephone connection, and it is just as important for the person on the other end of the connection to be able to hear the user. There are numerous applications where private two-way communication is useful, such as patrolling security guards, policeman, pilots, etc.

In some embodiments, in addition to communications with a remote site and module 60, relay unit 74 may receive from and/or transmit to remote device 75 (e.g., a CD player, DVD player, radio, telephone) via link 76', such as a conventional cable connection, a wireless link, or other means. Thus, in other embodiments, signals may be sent from module 60 to remote device 75, and from there to relay unit 74 (which may communicate with a remote site), and back again. For instance, remote device 75 may be a cordless phone receiving and sending signals to module 60 over link 77 and to relay unit 74 (a phone base station, in this case) over link 76', which base station send signals to a remote site, in this case, a telephone network via a land-line.

Signals received through antenna 64 are processed in an appropriate manner, e.g., amplified, demodulated, and/or conditioned, by circuitry contained within telemetry circuits 69 and signal processing circuits 67. Once appropriately processed, the signals are presented to speaker 65. Speaker 65 is a transducer that transduces the electrical signals into audio sound waves 78. Such audio sound waves 78 then propagate into the ear canal 30 at the proximal end 38 of the tunnel 40, where they can be readily heard by the user.

Sounds spoken by the user may also be sensed by microphone 63, when turned on, amplified and processed by the sound and signal processing circuits 67, and presented to the telemetry circuits 69, where they can be transmitted to relay unit 74, or other remote device 75, through communications link 76/77, where they may be further transferred to other individuals, at distant locations, over a land line, cellular, or other established linking network.

Because of the features described above allowing a user to be telecommunicatively coupled with a land line or cellular network, the present invention also lends itself for use with the next generation cell phone protocol (USTM). With such protocol, a permanent connection may be established between the "phone" (which would typically be relay station 74 and/or remote device 75 shown in FIG. 5; but which could, in some embodiments, be processing circuits 67 and/or telemetry circuits 69 carried in module 60) and the USTM network. Through the USTM network numerous internet-related features are made possible. For example, with USTM protocol, a user has the ability to write, send and receive email, connect to the internet and search for and receive information, as well as conduct a conventional telephone call.

Different signal processing techniques and strategies may be employed to enhance the ability of the user to benefit from the signal processing, amplification, and presentation through speaker 65. Relay unit 74 may therefore include, when necessary or desired, programming means allowing the user or an assistant to initially program the operation of the personal sound link module, or subsequently adjust the programming of the module after some amount of use. Different signal processing strategies may be selected through the external programmer contained within relay unit 74, and may be modified, from time to time, as needed or desired. The speaker 65 transduces the electrical signals received from the signal processing circuits 67 into audio sound waves 78. Such audio sound waves 78 then propagate into the ear canal 30 at the proximal end 38 of the tunnel 40, where they can be readily heard by the user.

Either relay unit 74, and/or remote device 75, may be fitted with such controls allowing the user to program the operation of the signal processing circuits 67. In other embodiments, a separate remote control unit 75' is provided, which includes means for establishing a telemetry link 77' with the telemetry circuits 69 of the module 60 through the antenna coil 64. Thus, the user may control certain parameters associated with the operation of the module 60, such as the amplitude of signal 78 that is emitted from acoustic transducer 65 (i.e., volume control), or the frequencies of the signals (i.e., tone control) that are allowed to be emitted from acoustic transducer 65. Link 77' may be an RF link. Alternatively, in some embodiments, link 77' may be another type of link, such as an infrared link, or a magnetic link. In other embodiments, the ability to control volume and/or tone may be included within remote device 75 and/or relay unit 74.

In one preferred embodiment, signals that are sent and received by telemetry circuits 69 are coded in a way that only designated target and source devices can be linked through the telemetry links 76, 76', 77, 77'. One possible RF telecommunications link that may be used to accomplish this goal is known as Bluetooth. A Bluetooth link advantageously has an identification (ID) code for each device incorporated into its protocol.

Figure 6A:
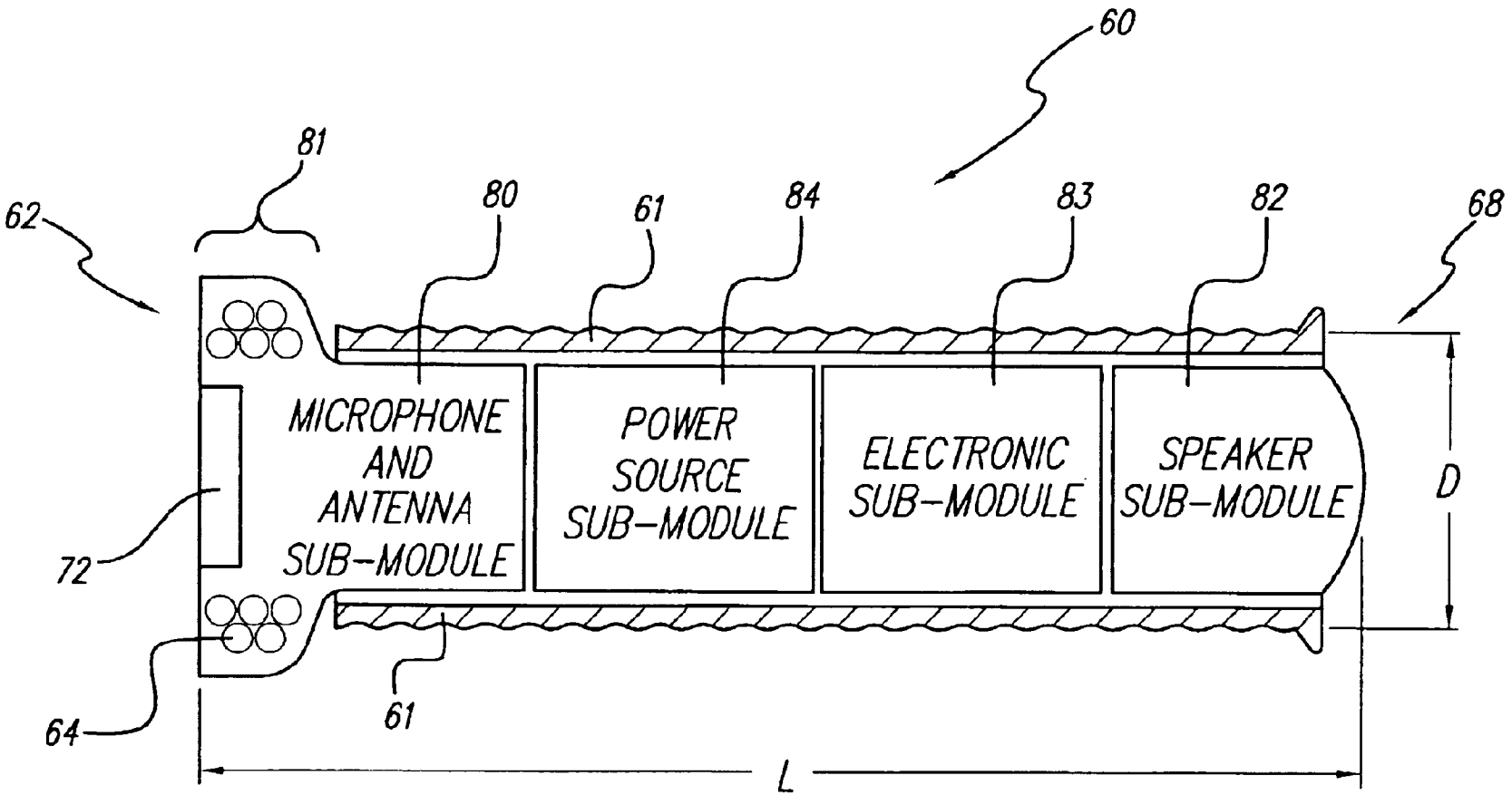
FIG. 6A illustrates one embodiment of the personal sound link module of the present invention and an example of how it may be packaged.

Turning next to FIG. 6A, a representative packaging scheme for the personal sound link module 60 is illustrated. The case 61 of module 60, in this instance, is tubular in shape. Case 61 may have a ribbed, score, or otherwise roughened outer side wall or it may have a smooth outer side wall.

Figure 6B:
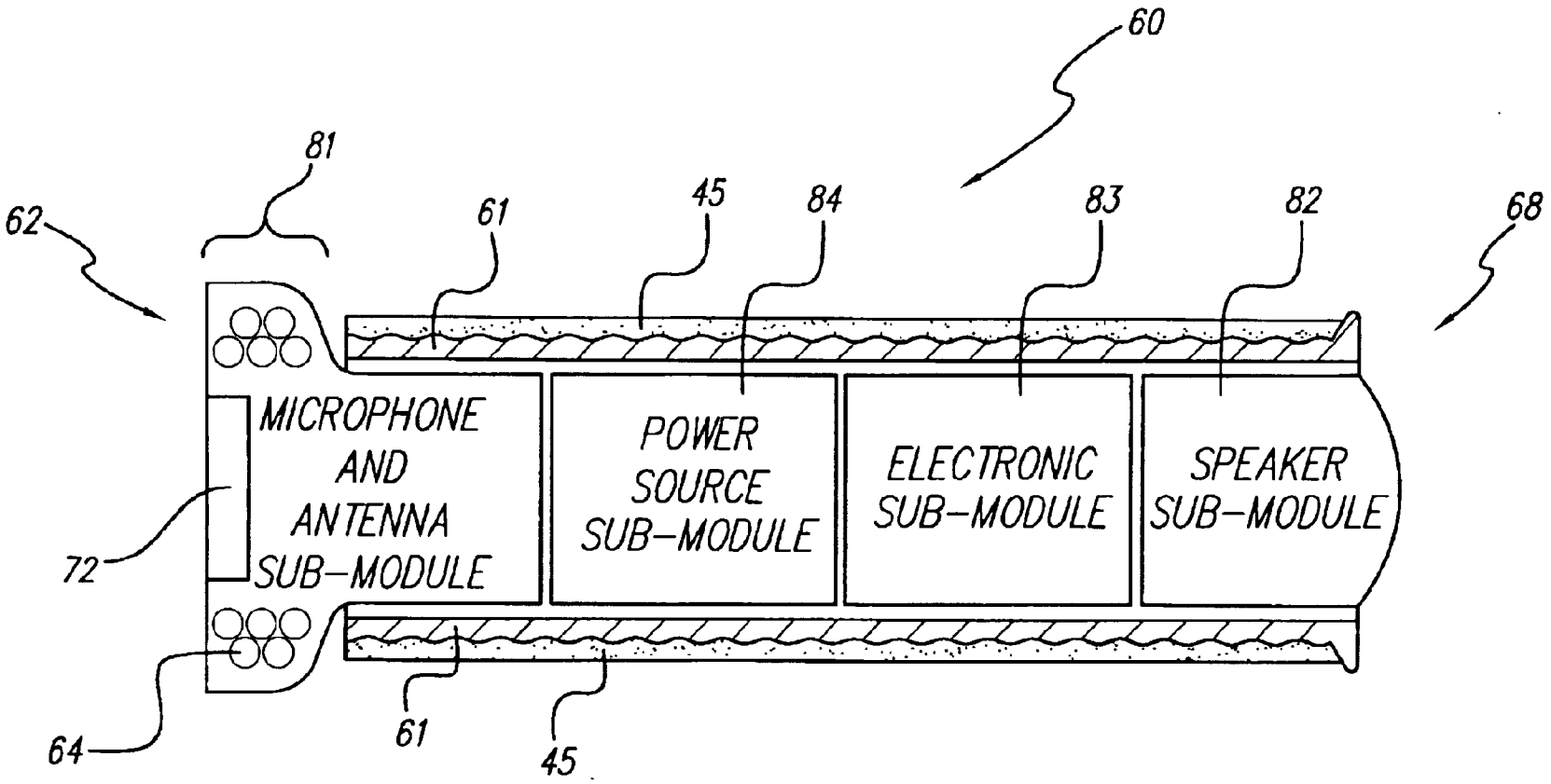
FIG. 6B shows the module of FIG. 6A coated with a steroid or drug.

In accordance with one advantageous embodiment of the invention, and as shown in FIG. 6B, case 61 may be coated with a layer 45 of a steroid(s) or other drug(s) adapted to minimize the risk of infection and/or inflammation. As in the earlier discussion of coating tube 44, the steroid(s) or drug(s) may be embedded in a suitable carrier substance that dissolves over time, thereby eluting or dispensing the drugs or steroids to the surrounding tissue over a period of time.

The case 61 has a diameter D sized to fit snugly within tunnel 40 or tube 44. Further, case 61 has a length L such that when module 60 is properly inserted into the tunnel 40, or tube 44, the proximal end 62 of the module 60 will be located near the proximal end 48 of the tunnel 40, and the distal end 68 of the module 60 will be near the distal end 38 of the tunnel 40. The case 61 may be made from any suitable biocompatible material, such as metal, silicone rubber, Silastic, or other suitable polymer.

For the embodiments illustrated in FIGS. 6A and 6B, there are four sub-modules end-to-end inside tubular case 61. At the proximal end 62 of module 60 is a microphone and antenna sub-module. In order to facilitate handling of module 60, and in particular to facilitate removing module 60 from tunnel 40 or tube 44, the microphone and antenna sub-module 80 may have a head portion 81. The head portion 81, like the head of a pin or the head of a nail, allows a user to physically grasp the head portion during insertion or removal in order to apply the necessary insertion or removal forces to the module. In one embodiment, coil windings of the antenna 64 are physically located within head portion 81. In other embodiments, head portion 81 may be, for instance, a part of case 61.

The connector 72 is also preferably formed within sub-module 80 so as to face proximally. This allows a cable to be connected to the connector, when desired or needed. Further, such connector provides a way for batteries to be recharged, for instance, when personal sound link module 60 is removed from the tunnel 40 or tube 44 and placed in a charging cradle (not shown).

In an alternative embodiment, the connector 72 located at the proximal end of the module may also facilitate a cabled connection to remote device 75 such as a remote microphone. For instance, a microphone may be carried at another location on the user's body, or a microphone may be located remotely from the user, e.g., as in a classroom setting where a teacher's microphone may be wired to individual desks throughout the classroom. The connector 72, as has been indicated, may also serve as an input to an external signal source, such as an AM/FM radio, an intercom, a CD player, a telephone, etc. In this way, connector 72 facilitates extending the personal sound link module 60 to the environment surrounding the user.

In yet another embodiment of the invention, a plug-in extension of the personal sound link module 60 may be attached to the proximal end of the module through the connector 72. Such extension may include a different type of antenna, or microphone, or auxiliary power source, or other performance enhancing circuitry. In one embodiment, such plug-in extension may contain an AM/FM or other radio that may be tuned to a desired station. In still another embodiment, an AM/FM radio receiver is included within the telemetry circuits 69 contained within the module.

At distal end 68 of tubular case 61 of personal sound link module 60 is a speaker sub-module 82. An electronic sub-module 83 and a power source sub-module 84 fill the remaining space within case 61. Electronic sub-module 83 includes signal processing circuits 67 and telemetry circuits 69. Power source module 84 includes a suitable power source, such as a primary battery, rechargeable battery and/or super capacitor, and associated charging/replenishing circuitry. The charging/replenishing circuitry may, in some embodiments, be found in electronic sub-module 83 rather than within power source module 84. The power source may comprise a rechargeable battery of the same or similar type as is disclosed, e.g., in U.S. Pat. Nos. 6,185,452; 6,164,284; and/or 6,208,894, which patents are incorporated herein by reference.

While the invention herein disclosed has been described by means of specific embodiments and applications thereof, numerous modifications and variations could be made thereto by those skilled in the art without departing from the scope of the invention set forth in the claims.

What is claimed is:

1. A personal sound link module (60) adapted for insertion into a tunnel (40) connecting a retro-auricular space (50) to an ear canal (30), comprising:

a case (61), said case having a layer of at least one of a steroide or drug coated thereon to minimize the risk of infection or inflammation;

electronic circuitry (67) housed in said case;

an acoustic transducer (65) electrically connected to said electronic circuitry and positioned at a distal end (68) of said case;

a telemetry circuit (69) also electrically connected to said electronic circuitry;

an antenna (64) connected to the telemetry circuit; and a power source (66) housed in said case and electrically connected to the electronic circuitry;

wherein the antenna is configured to receive a wireless signal from a remote device (75) and wherein the telemetry circuit demodulates the wireless signal received through the antenna, and wherein the electronic circuitry includes signal processing circuits for processing signals demodulated by the telemetry circuit and for presenting the processed signals to the acoustic transducer; and wherein the acoustic transducer includes circuits for converting the processed signals received from the electronic circuitry to sound waves, and for emitting the sound waves towards the ear canal.

2. The personal sound link module of claim 1 further including a hollow tube (44) adapted for insertion into the tunnel (40), and wherein the case (61) is adapted to be slidably inserted into said tube.

3. The personal sound link module of claim 1 further including a microphone (63), which microphone is electrically connected to the signal processing means contained within the electronic circuitry.

4. The personal sound link module of claim 3 wherein said telemetry circuitry includes a bidirectional wireless link over which RF signals may be transmitted to the module from a wireless network, and to the wireless network from the module.

5. The personal sound link module of claim 1 wherein the remote device comprises at least one of a radio, computer, palm pilot, CD player, DVD player, tape player, audio system, telephone, television, public address system, and private intercom system.

6. The personal sound link module of claim 1 further including means allowing the user to adjust the volume of the sound waves emitted from the acoustic transducer.

7. The personal sound link module of claim 6 further including means allowing the user to adjust the frequency content of the sound waves emitted from the acoustic transducer.

8. The personal sound link module of claim 1 wherein the power source comprises at least one of a primary battery, a rechargeable battery, and a super capacitor.

9. The personal sound link module of claim 1 further including a relay unit (74) containing circuitry for coupling a wireless signal to the personal sound link module through a telecommunications link (76), wherein the wireless signal contains audio information received from the remote device.

10. The personal sound link module of claim 1 further including a relay unit (74) containing circuitry for coupling a wireless signal to the personal sound link module, wherein the wireless signal contains audio information received from a remote site.

11. The personal sound link module of claim 10 wherein the remote site comprises at least one of a radio station, radio receiver, public address system, private intercom system, telephone land-line, cellular network, USTM network, television receiver, television station, and satellite.

12. The personal sound link module of claim 1 further includes means for generating and providing programming signals to the personal sound link module, and wherein the telemetry and signal processing circuits within the personal sound link module include means for responding to the programming signals so as to adjust the manner in which the telemetry and signal processing circuits process signals presented thereto.

13. The personal sound link module of claim 1 further including a connector (72) at a proximal end thereof for connecting the remote device to the personal sound link module.

14. The personal sound link module of claim 1 further including means for attaching an extension to the sound link module at a proximal end thereof, and wherein the extension includes means for enhancing the operation of the sound link module.

15. A personal sound link module adapted for insertion into a tunnel connecting a retro-auricular space to an ear canal, comprising:

a hollow tube adaoted for insertion into the tunnel said hollow tube being coated with a layer of at least one of a steroide or drug adapted to minimize the risk of infection or inflammation;

a case adapted to be inserted within said hollow tube;

electronic circuitry housed in said case;

an acoustic transducer electrically connected to said electronic circuitry and positioned at a distal end of said case;

a connector electrically connected to said electronic circuitry and positioned at a proximal end of said case;

a power source housed in said case and electrically connected to the electronic circuitry;

wherein the connector allows detachable connection of a remote device to the module, which remote device provides audio signals to the module;

wherein the electronic circuitry includes signal processing circuits for processing the signals received the remote device and for presenting the processed signals to the acoustic transducer; and wherein the acoustic transducer includes circuits for converting the processed signals received from the electronic circuitry to sound waves, and for emitting the sound waves towards the ear canal.

16. The personal sound link module of claim 15 wherein the remote device comprises at least one of a radio, computer, palm pilot, CD player, DVD player, tape player, audio system, telephone, television, public address system, and private intercom system.

17. A personal sound link module adapted for insertion into a tunnel connecting a retro-auricular space to an ear canal, comprising:

a case, said case having a layer of at least one of a steroided or drug coated thereon to minimize the risk of infection or inflamation;

means within said case for receiving wireless signals from a remote source, which signals are representative of sound waves;

means within said case and connected to said receiving means for demodulating the wireless signals received at the receiving means;

means within said case and connected to said demodulating means for processing the demodulated signals representing sound waves;

means within said case and connected to said processing means for converting said processed signals to sound waves and for emitting such sound waves towards the ear canal; and means within said case and connected to at least the processing means for providing power to said module.

18. The personal sound link module of claim 17 wherein the remote source comprises at least one of a radio, radio station, radio receiver, computer, palm pilot, CD player, DVD player, tape player, audio system, telephone, telephone land-line, cellular network, USTM network, television, television receiver, television station, satellite, public address system, and private intercom system.

19. A method of providing a personal sound link to a user, comprising:

making a tunnel through the soft tissue of the user that connects the retro-auricular space behind the pinna with the ear canal;

inserting inside the tunnel a personal sound link module, having a case adapted for insertion into the tunnel, said case having a layer of at least one of a steroide or drug coated thereon to minimize the risk of infection or inflammetion when said module is inserted into the tunnel, wherein an acoustic transducer is located at a distal end of the module, and wherein an antenna, a power source, signal processing circuits, and telemetry means are also located within the module for allowing wireless telecommunicative contact to be established with the module; end transmitting signals from a remote location;

receiving the signals through the antenna and processing the received signals with the signal processing circuits; and applying signals to the acoustic transducer at the distal end of the module, whereby sound signals are broadcast into the ear canal of the user.

20. The method of providing a personal sound link of claim 19 wherein the remote location comprises at least one of a radio, radio station, radio receiver, computer, palm pilot, CD player, DVD player, tape player, audio system, telephone, telephone land-line, cellular network, USTM network, television, television receiver, television station, satellite, public address system, and private intercom system.

* * * * *